US006767318B2

(12) United States Patent
Spatafora et al.

(10) Patent No.: US 6,767,318 B2
(45) Date of Patent: Jul. 27, 2004

(54) METHOD AND UNIT FOR FEEDING PACKAGING MATERIAL TO AN OPERATING UNIT

(75) Inventors: Mario Spatafora, Bologna (IT); Alberto Polazzi, Rastignano (IT)

(73) Assignee: G. D Societa' per Azioni, Bologna (IT)

( * ) Notice: Subject to any disclaimer, the term of this patent is extended or adjusted under 35 U.S.C. 154(b) by 0 days.

(21) Appl. No.: 10/143,512

(22) Filed: May 10, 2002

(65) Prior Publication Data

US 2003/0032538 A1 Feb. 13, 2003

(30) Foreign Application Priority Data

May 11, 2001 (IT) ..... BO2001A0288
May 11, 2001 (IT) ..... BO2001A0287

(51) Int. Cl.[7] ..... B31C 13/00

(52) U.S. Cl. ..... 493/303; 493/305; 414/911; 242/554; 242/555.5; 242/559; 242/559.2; 242/559.4; 242/560.1

(58) Field of Search ..... 493/303, 305; 242/550, 554, 555.5, 558, 559, 559.2, 559.4, 560, 560.1; 414/911

(56) References Cited

U.S. PATENT DOCUMENTS 5,169,271 A * 12/1992 Yamashita ..... 414/27
5,249,757 A * 10/1993 Draghetti et al. ..... 242/559.1
5,487,638 A * 1/1996 Salsburg et al. ..... 414/796.9
5,593,107 A * 1/1997 Focke et al. ..... 242/559.4
5,653,087 A * 8/1997 Spada et al. ..... 53/168
6,276,628 B1 * 8/2001 Focke et al. ..... 242/559.1
6,402,083 B1 * 6/2002 Horn et al. ..... 242/559.2
6,604,704 B2 * 8/2003 Kiprowski ..... 242/559.1

FOREIGN PATENT DOCUMENTS

| | | |
|---|---|---|
| DE | 90 17 477.1 | 4/1992 |
| EP | 0 775 659 | 5/1997 |
| EP | 0 936 172 | 8/1999 |
| EP | 0 994 057 | 4/2000 |

OTHER PUBLICATIONS

US 2001/0045490 A1 Kiprowski Nov. 29, 2001.*

* cited by examiner

*Primary Examiner*—Eugene Kim
*Assistant Examiner*—Christopher R Harmon
(74) *Attorney, Agent, or Firm*—Ladas & Parry

(57) ABSTRACT

On a machine for producing articles, in particular a packaging machine for producing packets of cigarettes, a reel, laid flat on a support, is fed, by means of a transfer device, to a relative unwinding pin fitted to the periphery of a rotary platform rotating about a substantially horizontal axis; the unwinding pin being set to a substantially radial position with respect to the platform axis; the rotary platform being rotated to set said unwinding pin to a vertical receiving position facing upwards; the reel being fitted downwards onto the unwinding pin in the receiving position; and the unwinding pin being rotated, with respect to the rotary platform, into an axial position with respect to the rotary platform before unwinding the reel.

17 Claims, 5 Drawing Sheets

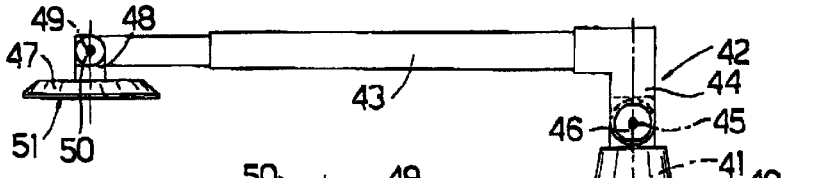
Fig.6
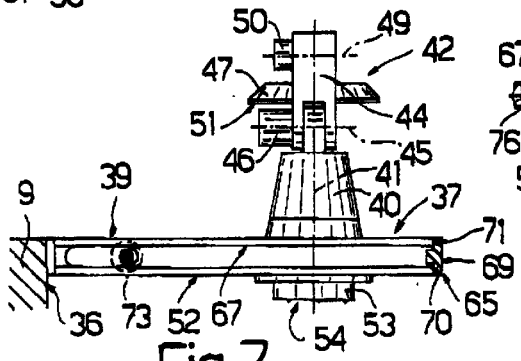
Fig.7
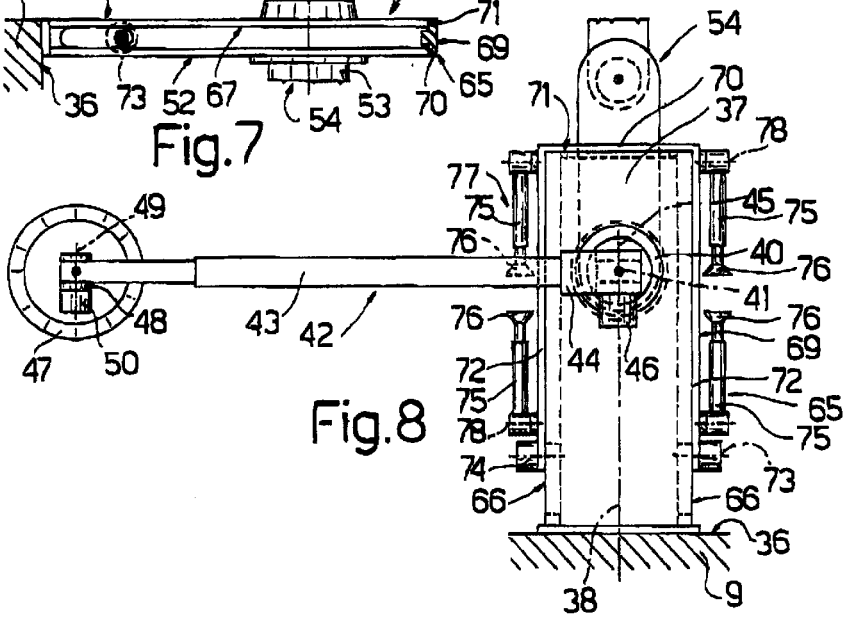
Fig.8
Fig.2
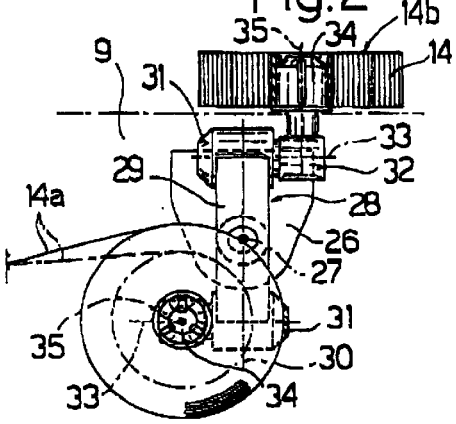
Fig.4
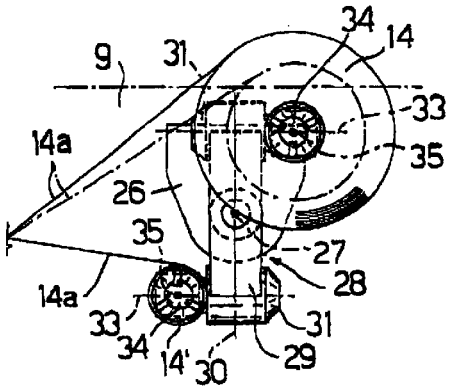

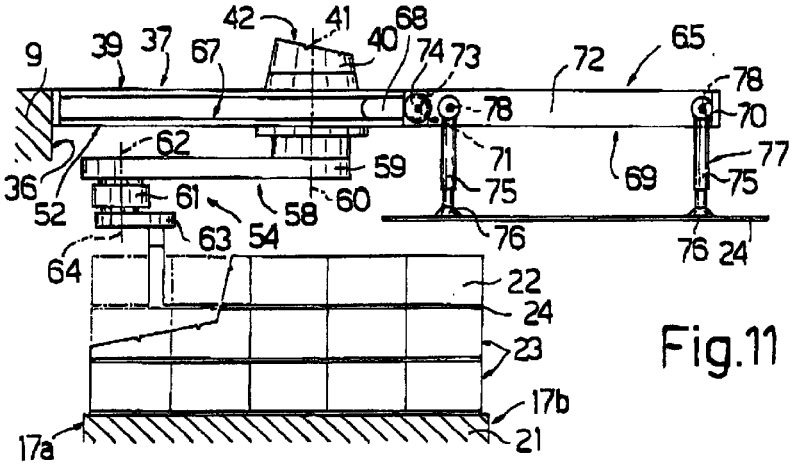
Fig.11
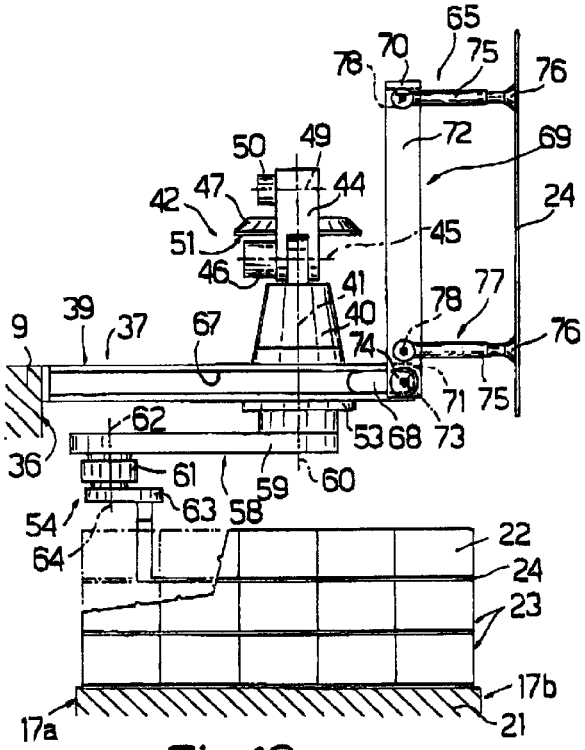
Fig.12
Fig.5
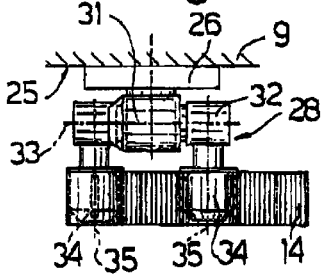
Fig.3
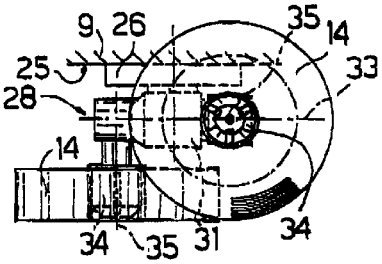

METHOD AND UNIT FOR FEEDING PACKAGING MATERIAL TO AN OPERATING UNIT

The present invention relates to a method of feeding packaging material to an operating unit.

In particular, the present invention relates to a method of feeding packaging material to an operating unit of a machine for producing and/or manipulating articles and comprising a feed unit for feeding packaging material at least partly in the form of reels laid flat on a support, the method being of the type comprising the steps of feeding each said reel, by means of a transfer device, to a relative unwinding pin of the feed unit, and unwinding said reel on the relative unwinding pin.

BACKGROUND OF THE INVENTION

Methods of the above type are disclosed in, or may be derived from EP-A-0 775 659.

The present invention may be used to advantage in any field of industry in which said operating unit forms part of a machine for producing and/or manipulating articles of various types. For example, the present invention may be used in paper or textile mills, and to particular advantage in the tobacco industry for producing tobacco articles such as cigarettes, packets of cigarettes or similar.

In the following description, specific reference is made, purely by way of example, to packaging machines for producing packets of cigarettes.

SUMMARY OF THE INVENTION

It is an object of the present invention to provide a feeding method of the above type rendering the aforementioned steps of feeding and unwinding the reels as simple an straightforward as possible.

According to the present invention, there is provided a method of feeding packaging material to an operating unit of a machine for producing and/or manipulating articles and comprising a feed unit for feeding packaging material at least partly in the form of reels laid flat on a support, the method comprising the steps of feeding each said reel, by means of a transfer device, to a relative unwinding pin of the feed unit, and unwinding said reel on the relative unwinding pin, characterized in that said unwinding pin is fitted to the periphery of a rotary platform rotating about a substantially horizontal axis; the method comprising the further steps of setting said unwinding pin to a substantially radial position with respect to said axis; rotating said rotary platform to set said unwinding pin to a vertical receiving position facing upwards; fitting the relative said reel downwards onto said unwinding pin in said receiving position; and rotating said unwinding pin, with respect to said rotary platform, into an axial position with respect to the rotary platform; said reel being unwound with the relative unwinding pin in said axial position.

The method set forth above preferably comprises the further steps of rotating said rotary platform (28) 180°; and restoring said unwinding pin (34) to said radial position to detach a core (14') of the relative said reel (14) by force of gravity from the unwinding pin (34).

The present invention also relates to a feed unit for feeding packaging material, in particular packaging material in reels, to an operating unit.

According to the present invention, on a machine for producing and/or manipulating articles and comprising an operating unit, there is provided a feed unit for feeding packaging material at least partly in the form of reels supported on a support in a flat position; the feed unit comprising at least one unwinding pin for said reels, and a transfer device for transferring each said reel directly from said support to said unwinding pin; said feed unit being characterized by comprising at least one rotary platform rotating about a respective substantially horizontal axis; said unwinding pin being connected to an outer periphery of said rotary platform to oscillate, with respect to the rotary platform and about a respective hinge axis crosswise to both the unwinding pin and the axis of rotation of the rotary platform, between a substantially radial position and a substantially axial unwinding position with respect to the axis of rotation of the rotary platform; said rotary platform rotating about the respective said axis of rotation to set said unwinding pin, when in said radial position, selectively to an upward-facing substantially vertical receiving position to receive the relative said reel flat from above, and to a downward-facing substantially vertical unloading position to unload a core of the relative said reel.

BRIEF DESCRIPTION OF THE DRAWINGS

The present invention will now be described by way of example with reference to the accompanying drawings, in which:

FIGS. 2 and 3 show elevations of a first detail of FIG. 1 in two different operating positions;

FIGS. 4 and 5 show plan views of the FIGS. 2 and 3 detail in the FIGS. 2 and 3 positions respectively;

FIGS. 6, 7 and 8 show side, rear and plan views respectively of a second detail of FIG. 1;

FIGS. 9, 10, 11 and 12 show elevations of a third detail of FIG. 1 in four different operating positions;

DETAILED DESCRIPTION OF THE INVENTION

Figure 1:
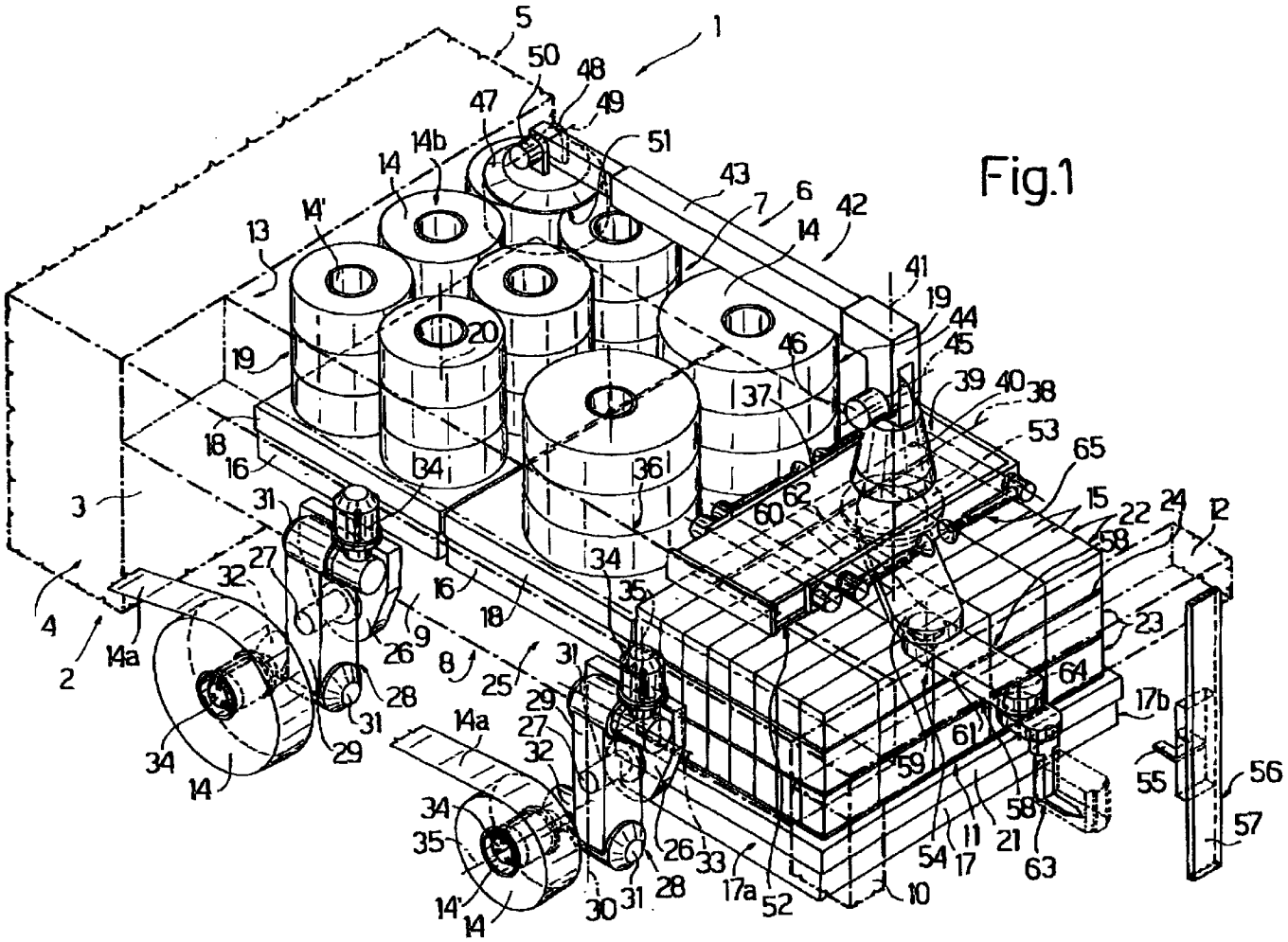
FIG. 1 shows a schematic partial view in perspective, with parts removed for clarity, of a cigarette packaging machine comprising a preferred embodiment of a feed unit in accordance with the present invention.
Figure 9:
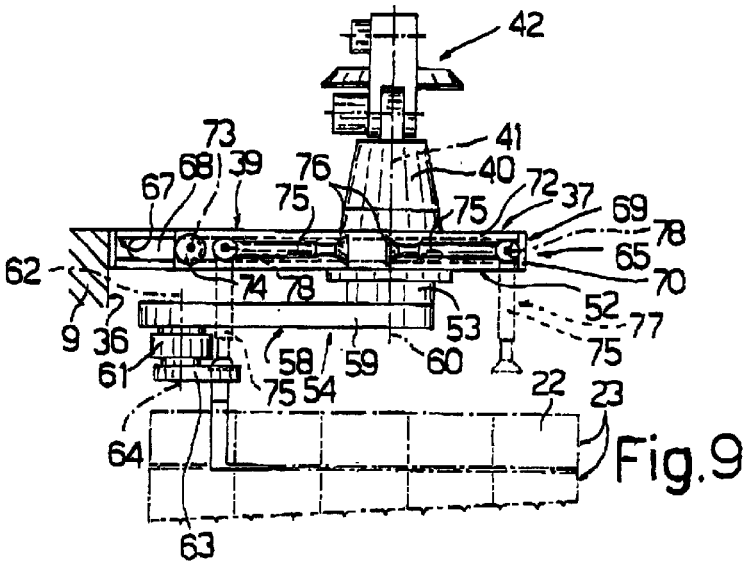
Figure 10:
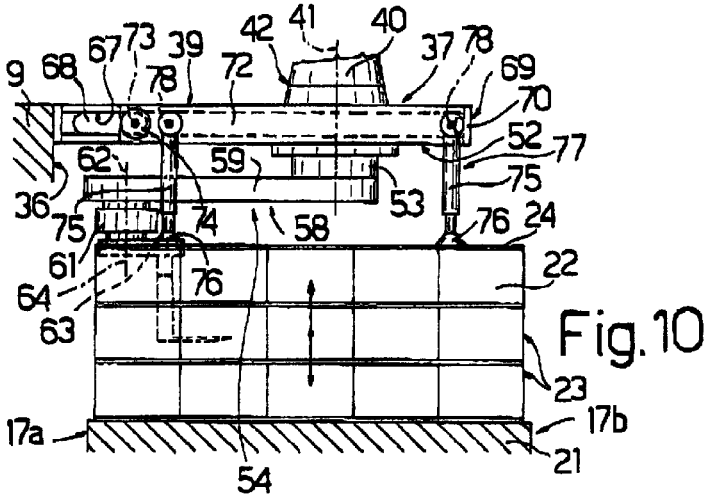
Figure 13:
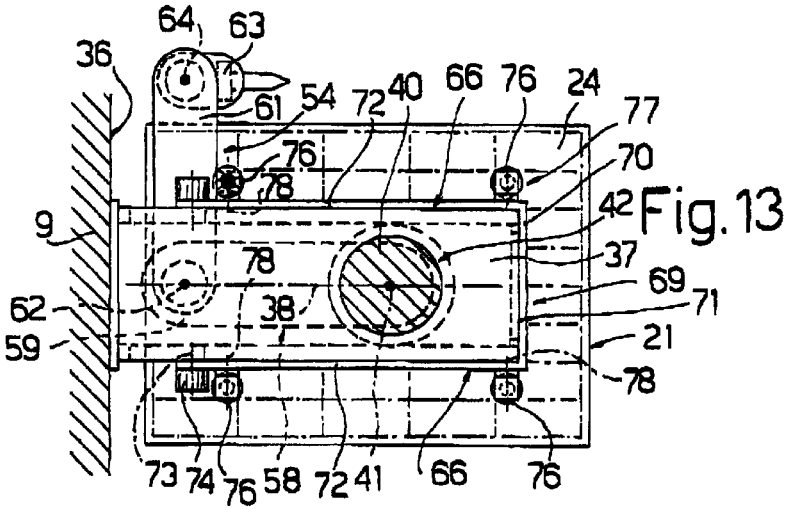
FIG. 13 shows a plan view of the FIGS. 9–12 detail in the FIG. 10 position.

Number 1 in FIG. 1 indicates as a whole a machine for producing articles—in the example shown, a cigarette packaging machine—and comprising a frame 2 having a vertical intermediate wall 3 extending crosswise to a machine front 4 and dividing machine 1 into two side by side sections: a first section defined by an operating unit 5; and a second section defined by a feed unit 6 for feeding packaging material 7.

Feed unit 6 comprises a front portal 8 substantially aligned with machine front 4 and in turn comprising a horizontal cross member 9, one end of which is integral with a top portion of wall 3, and the other end of which is supported on an upright 10 shared by a further portal 11 (shown only partly), the cross member 12 of which faces wall 3, extends rearwards with respect to machine front 4, and is perpendicular to cross member 9.

Wall 3 and portals 8 and 11 define a storage area 13 for packaging material 7, which comprises reels 14 of various types, and blanks 15 for known rigid packets not shown. More specifically, inside storage area 13, three platforms— two indicated 16 and one indicated 17—are aligned side by side as of wall 3 and in the direction of cross member 9, and are movable vertically, by respective known vertical linear actuators not shown, to and from a lowered position at floor level.

In a variation not shown, platforms 16 and 17, or at least platforms 16 only, are fixed at floor level and simply define respective storage areas.

Each platform 16 is designed to receive a respective pallet 18 supporting a respective number of stacks 19 of reels 14 laid flat one on top of the other in each stack 19 with their respective axes 20 oriented vertically; and platform 17 is designed to receive a pallet 21 supporting a number of packs 22 of blanks 15 arranged in a number of superimposed layers 23 separated by sheets 24 of paper.

As shown in FIGS. 1 to 5, a front surface 25 of cross member 9 is fitted with vertical brackets 26, each having, at the front, a powered pin 27, which has a horizontal axis perpendicular to front surface 25 and is fitted with a respective rotary platform 28 for unwinding reels 14. The example shown comprises two rotary platforms 28, though any number may be provided. Each rotary platform 28 comprises a swivel defined by a beam 29, which lies in a vertical plane perpendicular to relative pin 27, is fitted along its centerline to pin 27, and rotates in 180° steps about the axis of relative pin 27 to assume stationary work positions in which the longitudinal axis 30 of beam 29 is positioned vertically.

Each end of beam 29 is fitted with the casing of a motor 31, the output shaft 32 of which oscillates 90° about its own axis 33 perpendicular to axis 30. Shafts 32 project in opposite directions from beam 29 and support respective expansible unwinding pins 34, each of which is mounted to rotate about a respective axis 35 perpendicular to respective axis 33, and oscillates, with relative shaft 32 and about relative axis 33, between a loading-unloading position wherein pin 34 extends beyond the relative end of relative beam 29 and relative axis 35 is positioned parallel to axis 30 of beam 29, i.e. radially with respect to pin 27, and a horizontal unwinding position wherein pin 34 faces forward with respect to relative beam 29 and relative axis 35 is positioned crosswise to the axis of beam 29 and to front surface 25 of cross member 9, i.e. axially with respect to pin 27.

Over platform 17, a bracket 37 projects rearwards from a vertical rear surface 36 of cross member 9, parallel to front surface 25. More specifically, bracket 37 is substantially rectangular with a horizontal longitudinal axis 38 perpendicular to rear surface 36 of cross member 9, extends almost the whole of its length over a front portion of platform 17, and is narrower than platform 17.

As shown clearly in FIGS. 1 and 6 to 8, the horizontal top surface 39 of bracket 37 is fitted integrally with the base of a powered swivel 40 rotating about a vertical axis 41 and forming part of a transfer device 42 for transferring reels 14 directly from respective pallet 18 to relative pin 34. In addition to swivel 40, transfer device 42 also comprises a telescopic arm 43, which is adjustable in length by means of a known internal hydraulic device not shown. One end of telescopic arm 43 is connected by a fork 44 to the top end of swivel 40, and is rotated, with respect to swivel 40 and by a reversible motor 46, about a horizontal axis 45 perpendicular to axis 41. At the opposite end to that fitted with fork 44, telescopic arm 43 supports a pneumatic gripping head 47, which is movable with telescopic arm 43 to reach any point over platforms 16, is connected to telescopic arm 43 by a fork 48, and is rotated, with respect to telescopic arm 43 and about an axis 49 parallel to axis 45, by a reversible motor 50 connected to motor 46 by an electric axis (not shown) to rotate pneumatic head 47 about axis 49 equally and oppositely with respect to rotation of telescopic arm 43 about axis 45 by motor 46. More specifically, motors 46 and 50 are so regulated as to maintain a bottom suction surface 51 of pneumatic head 47 horizontal and parallel to platforms 16 at all times.

As shown in FIGS. 9 to 13, a horizontal bottom surface 52 of bracket 37 is fitted integrally with the base 53 of a transfer device 54 for transferring packs 22 of blanks 15 from pallet 21 to a conveyor pocket 55 of a conveyor 56 (shown only partly) comprising a vertical portion 57 extending downwards from cross member 12, and a substantially horizontal bottom branch (not shown) for transferring packs 22 successively to a known user device (not shown) forming part of operating unit 5. In addition to base 53, transfer device 54 also comprises an articulated arm 58, which is movable in a horizontal plane and comprises a powered arm 59 connected to the bottom end of base 53 to rotate, with respect to base 53, about a vertical axis 60 coincident, in the example shown, with axis 41 but which may be offset with respect to axis 41.

At its free end, arm 59 supports a further powered arm 61, which rotates with respect to arm 59 about a vertical axis 62 and supports, at its own free end, a known powered gripping head 63 connected to arm 61 to rotate, with respect to arm 61, about a vertical axis 64.

Arms 59 and 61 are of such lengths as to enable gripping head 63 to reach conveyor pocket 55, to be positioned at any point over platform 17, and to be set to a rest position (FIG. 13) alongside a front edge 17*a* of platform 17.

Feed unit 6 comprises a pickup device 65 carried by bracket 37 and for removing sheets 24.

As shown more clearly in FIGS. 9 to 13, bracket 37 has two opposite longitudinal lateral surfaces 66, on each of which is formed a guide 67 parallel to axis 38 and along which runs a respective slide 68. In addition to guides 67 and slides 68, pickup device 65 also comprises a U-shaped frame 69, in turn comprising a cross member 70 parallel to and facing a lateral end surface 71 of bracket 37, and two arms 72 parallel to and facing respective surfaces 66 and fitted to respective slides 68 to enable frame 69, by means of a known linear actuating device (not shown), to slide, along bracket 37 and parallel to axis 38, between a withdrawn position in which cross member 70 substantially contacts surface 71, and a forward position in which almost the whole length of frame 69 projects beyond the free end of bracket 37. Arms 72 are also connected to respective slides 68 to rotate roughly 90°—with respect to slides 68, about an axis 73 crosswise to axis 38, and by means of a drive device 74—between a lowered position coplanar with bracket 37, and a substantially vertical raised position.

Pickup device 65 also comprises two pairs of tubular arms 75, each of which is fitted on the free end with a suction cup 76 connected to a suction circuit 77 of which tubular arms 75 form an end portion, and is hinged at the other end to a respective arm 72 to oscillate 90°—by means of a known actuating device (not shown) and about a respective horizontal axis 78 perpendicular to longitudinal axis 38—between a rest position in which tubular arms 75 are aligned with arms 72 and parallel to longitudinal axis 38, and a gripping position in which tubular arms 75 are crosswise to arms 72 and extend towards platform 17. More specifically, each arm 72 supports a respective pair of tubular arms 75, which, in the rest position, are coaxial with each other, with respective suction cups 76 facing each other. Tubular arms 75 are all located over platform 17, and are each of a length which, added to the length of bracket 37, is greater than the distance between cross member 9 and the rear edge 17*b* of platform 17.

In actual use, machine 1 must be supplied continually with packaging material 7, which, as stated, is fed into storage area 13 of feed unit 6 without being unloaded off pallets 18, 21 onto which it is originally loaded by the makers. More specifically, pallets 18 of reels 14 are loaded onto respective platforms 16, with reels 14 still laid flat in the original horizontal positions with axes 20 oriented vertically. Pallets 18 are obviously standard types, on which reels 14 are arranged in given orders known to a control unit (not shown) of machine 1, so that, when pallets 18 are positioned on respective platforms 16, the relative reels 14 assume, inside storage area 13, given positions known accurately enough to relative transfer device 42.

With reference to FIGS. 1 to 5, in normal operating conditions, each rotary platform 28 (FIG. 1) is positioned with respective beam 29 positioned vertically, and with respective bottom pin 34 in the horizontal unwinding position, and supports one reel 14 fitted to bottom pin 34 and from which a web 14*a* is unwound and fed to operating unit 5 by means of a known unwinding device (not shown) forming part of operating unit 5. As reel 14 is being unwound normally, top pin 34 is set to the vertical loading-unloading position with axis 35 parallel to axes 20 of reels 14 on pallets 18, and, upon the unwinding reel 14 reaching a given diameter, transfer device 42 is activated to move bottom surface 51 of pneumatic head 47 over and onto a substantially horizontal top surface 14*b* of an identical new reel 14 laid flat on one of pallets 18. The above movement of pneumatic head 47 is obtained by rotating telescopic arm 43 about axis 41, oppositely rotating telescopic arm 43 and pneumatic head 47 about respective axes 45 and 49, and possibly adjusting the length of telescopic arm 43 and raising relative platform 16. The new reel 14 is gripped by suction by pneumatic head 47, is lifted up, and is moved linearly—with axis 20 still oriented vertically, and by moving telescopic arm about axes 41 and 45 and possibly adjusting the length of telescopic arm 43—into a position over and coaxial with top pin 34. The new reel 14 is then fitted and released onto top pin 34 (FIGS. 2 and 3) by means of a vertical linear movement obtained by rotating telescopic arm 43 downwards about axis 45, simultaneously and equally rotating pneumatic head 47 upwards about axis 49, and simultaneously extending telescopic arm 43.

At this point, top motor 31 is activated to move top pin 34 into the horizontal unwinding position (FIGS. 4 and 5) and the respective new reel 14 into an on-edge position, and, when the bottom reel 14 is about to run out, a known automatic splicing device (not shown) joins web 14*a* of the new reel 14 to web 14*a* of the run-out reel 14 in known manner (FIG. 4), and cuts web 14*a* of the run-out reel 14 to unwind the new reel 14. Bottom motor 31 is then activated to move bottom pin 34 into the vertical loading-unloading position, so that the core 14' of run-out reel 14 drops onto a tray (not shown) for collecting cores 14', and beam 29 is rotated 180° about the axis of pin 27 to invert the positions of the two pins 34 and restore rotary platform 28 to the initial normal working condition (FIG. 1).

Packs 22 are picked up one after another from relative layer 23 in known manner by gripping head 63 of transfer device 54, and are fed successively to conveyor pocket 55 by rotating arms 59 and 61 and gripping head 63 about respective axes 60, 62 and 64. When each layer 23 is finished and relative sheet 24 is fully exposed, articulated arm 58 is moved towards cross member 9 and into the FIG. 13 rest position with arm 59 substantially along the longitudinal axis 38 of bracket 37, and with arm 61 in front of front axis 78. Tubular arms 75 are then rotated downwards into the vertical position with respective suction cups 76 facing downwards; platform 17 is raised to bring the exposed sheet 24 into contact with suction cups 76; and suction circuit 77 is activated so that sheet 24 adheres to suction cups 76. At this point, platform 17 is lowered to detach sheet 24 from the underlying layer 23, and pickup device 65 is activated to move frame 69, originally in the normal withdrawn position, into the raised position by running slides 68 along respective guides 67 to the free end of bracket 37, and simultaneously rotating frame 69 about axis 73 by means of drive device 74. When frame 69 reaches the vertical raised position, suction cups 76 retain sheet 24 not only vertically but also, on account of said length of tubular arms 75, to the rear of rear edge 17*b* of platform 17, and therefore to the rear of the rear surface of pallet 21, which is at most 'the same size as platform 17, so that, when suction circuit 77 is deactivated, sheet 24 is released and drops into a bin (not shown) to the rear of platform 17.

Figure 14:
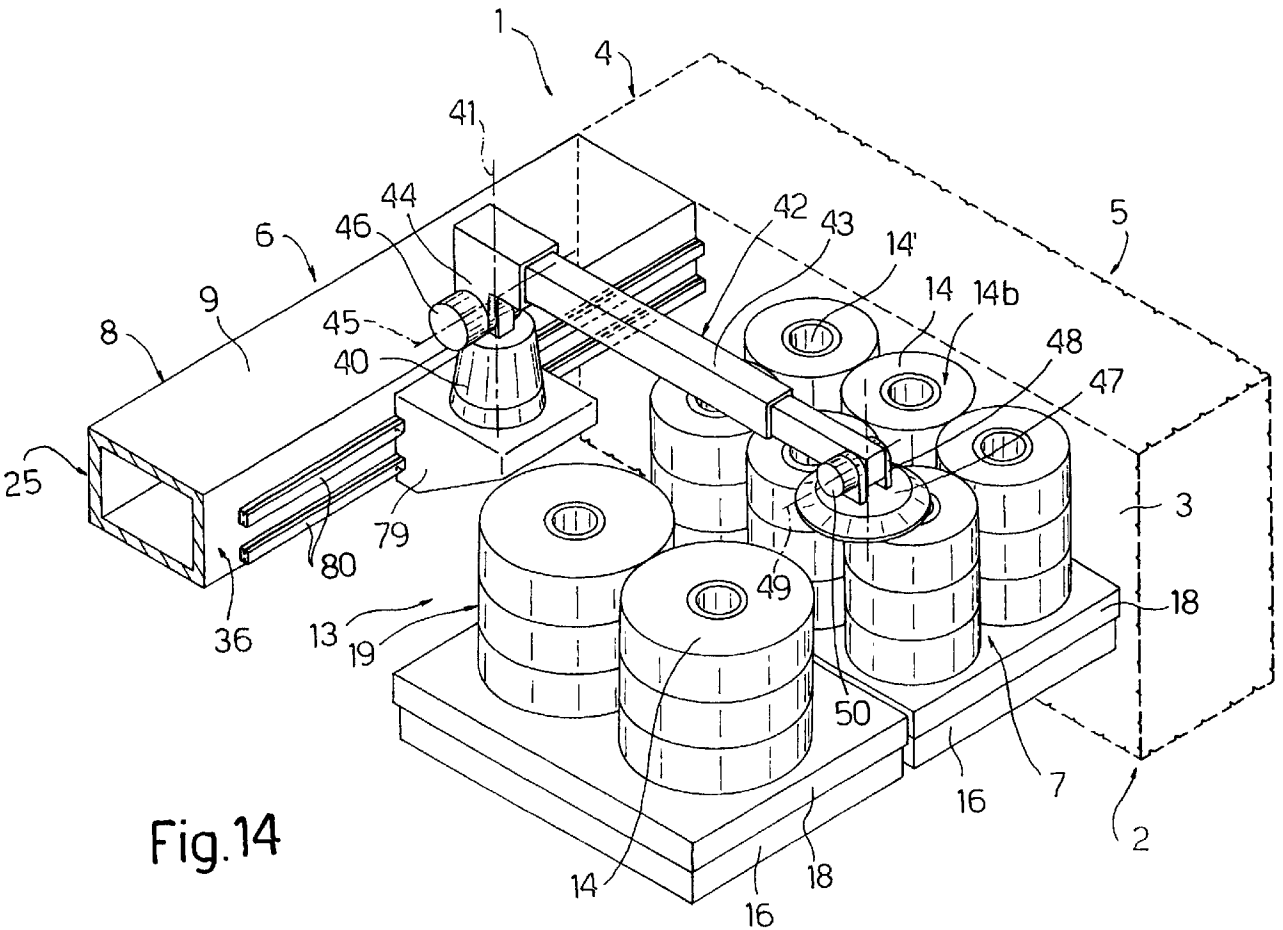
FIG. 14 shows a perspective view of a variant of the detail of FIGS. 6 to 8.

In the embodiment shown in FIG. 14, transfer device 42 is not mounted on bracket 37, but is supported by a motorised trolley 79 mounted for movement along a horizontal rail 80 fixed to a lateral surface of horizontal cross member 9 opposite to front surface 25 and facing storage area 13. In particular, rail 80 extends over bracket 37 and storage area 13 and alongside platform 16, and allows minimising the length of telescopic arm 43.

What is claimed is:

1. A method of feeding packaging material to an operating unit (5) of a machine for producing and/or manipulating articles and comprising a feed unit (6) for feeding packaging material (7) at least partly in the form of reels (14) laid flat on a support, the method comprising the steps of feeding each said reel (14), by means of a first transfer device (42), to a relative unwinding pin (34) of the feed unit (6), and unwinding said reel (14) on the relative unwinding pin (34); two said unwinding pins (34) being fitted to the periphery of a rotary platform (28) rotating about a substantially horizontal first axis (27) so as to rotate with respect to the rotary platform (28) about relevant horizontal second axes (33) transverse to the first axis (27); the method comprising the further steps of:

setting a first said unwinding pin (34) to a substantially radial position with respect to said first axis (27) by rotating the first unwinding pin (34) about the second axis (33) while a second said unwinding pin (34) is in an axial position with respect to the first axis (27) for supporting the unwinding reel (14), rotating said rotary platform (28) about the first axis (27) to set the first unwinding pin (34) to a vertical receiving position facing upwards and maintaining the second unwinding pin (34) in an axial position with respect to the first axis (27) for supporting an unwinding reel (14), fitting a relative new reel (14) downwards onto the first unwinding pin (34) in said receiving position, and rotating the first unwinding pin (34), with respect to said rotary platform (28) and about said second axis (33) into an axial position with respect to the rotary platform (28); said new reel (14) being unwound with the relative unwinding pin (34) in said axial position.

2. A method as claimed in claim 1 and comprising the further steps of rotating said rotary platform (28) 180°; and restoring each unwinding pin (34) to said radial position to detach a core (14') of the relative said reel (14) by force of gravity from the unwinding pin (34).

3. A method as claimed in claim 1, wherein said support is a pallet; the method comprising the steps of feeding said packaging material (7), together with the relative pallet (18), to a storage area (13) of the feed unit (6) adjacent to the operating unit (5); and transferring each said reel (14), by means of the first transfer device (42), directly from said pallet (18) to the relative unwinding pin (34) of the feed unit (6).

4. A method as claimed in claim 3, wherein said pallet (18) is fed to said storage area (13) onto a platform (16) movable vertically and located in the storage area (13); said platform (16) being moved vertically to make each said reel (14) accessible by said transfer device (42) at a given height.

5. A method as claimed in claim 3, wherein said pallet (18) is fed to said storage area (13) onto a platform (16); said transfer device (42) being carried by a trolley (79), which is moved alongside said first platform (16) to make each said reel (14) accessible by said transfer device (42) at a minimum given distance.

6. A method as claimed in claim 1, wherein a single gripping member (47) is used to transfer each said reel (14) directly from the relative support (18) to the relative said unwinding pin (34).

7. A method as claimed in claim 1, wherein each said reel (14) is laid flat on the relative said support (18) and is fitted flat to the relative said unwinding pin (34).

8. A method as claimed in claim 1, wherein each said reel (14) is laid flat on the relative said support (18) and is transferred from the support (18) to the relative said unwinding pin (34) by means of a straightforward linear movement.

9. A method as claimed in claim 1, wherein the packaging material (7) is partly in the form of reels (14) supported on at least one first pallet (18), and is partly in the form of blanks (15) arranged in packs (22) on at least one second pallet (21); the method comprising the steps of feeding said packaging material (7), together with the relative said pallets (18, 21), to the same storage area (13) adjacent to the operating unit (5), transferring each said reel (14), by means of the first transfer device (42), directly from said first pallet (18) to a relative unwinding pin (34), unwinding said reel (14) on the relative unwinding pin (34), and transferring each said pack (22) of blanks (15), by means of a second transfer device (54), to input conveying means (56) of said operating unit (5).

10. A method as claimed in claim 9, wherein said first and said second pallet (18, 21) are fed to said storage area (13) respectively onto a first and a second platform (16, 17) located side by side in the storage area (13).

11. A method as claimed in claim 10, and comprising the further step of moving at least said first platform (16) vertically to make each said reel (14) accessible by said first transfer device (42) at a given height.

12. A method as claimed in claim 9, wherein said packs (22) of blanks (15) are arranged on said second pallet (21) in a number of superimposed layers (23), each of which is separated by a sheet (24) from the adjacent underlying layer (23); the method comprising the further step of removing each said sheet (24) from said second pallet (21) by means of a pickup device (65) when the layer (23) over the sheet (24) is used up.

13. A method of feeding packaging material to an operating unit (5) of a machine for producing and/or manipulating articles and comprising a feed unit (6) for feeding packaging material (7) at least partly in the form of reels (14) laid flat on a support, the method comprising the steps of feeding each said reel (14), by means of a first transfer device (42), to a relative unwinding pin (34) of the feed unit (6), and unwinding said reel (14) on the relative unwinding pin (34), said unwinding pin (34) being fitted to the periphery of a rotary platform (28) rotating about a substantially horizontal axis (27); the method comprising the further steps of setting said unwinding pin (34) to a substantially radial position with respect to said axis (27); rotating said rotary platform (28), to set said unwinding pin (34) to a vertical receiving position facing upwards, fitting the relative said reel (14) downwards onto said unwinding pin (34) in said receiving position, and rotating said unwinding pin (34), with respect to said rotary platform (28), into an axial position with respect to the rotary platform (28); said reel (14) being unwound with the relative unwinding pin (34) in said axial position, wherein the packaging material (7) is partly in the form of reels (14) supported on at least one first pallet (18), and is partly in the form of blanks (15) arranged in packs (22) on at least one second pallet (21); the method comprising the steps of feeding said packaging material (7), together with the relative said pallets (18, 21), to the same storage area (13) adjacent to the operating unit (5), transferring each said reel (14), by means of the first transfer device (42), directly from said first pallet (18) to a relative unwinding pin (34), unwinding said reel (14) on the relative unwinding pin (34), and transferring each said pack (22) of blanks (15), by means of a second transfer device (54), to input conveying means (56) of said operating unit (5), wherein said first and said second pallet (18, 21) are fed to said storage area (13) respectively onto a first and a second platform (16, 17) located side by side in the storage area (13), wherein said first and said second transfer device (42, 54) and said pickup device (65) are all carried by a same supporting member (37) located over said second platform (17); said first transfer device (42) being located over said supporting member (37); said second transfer device (54) being located underneath said supporting member (37); said pickup device (65) being located on said supporting member (37), between said first and said second transfer device (42, 54); and the method comprising the further step of setting said second transfer device (54) to a position alongside said second platform (17) before said pickup device (65) is activated.

14. A method as claimed in claim 13, wherein said pickup device (65) comprises frame means (69) fitted to said supporting member (37) to move to and from a rest position in which said frame means (69) are located over the supporting member (37); and a number of gripping members (76) movable, with respect to said frame means (69), to and from a rest position coplanar with the frame means (69); the method comprising the further steps of lowering said gripping members (76) to position the gripping members (76) a given distance from said frame means (69); imparting to said gripping members (76) and to said sheet (24) a relative vertical approach movement so that said sheet (24) engages said gripping members (76); activating said gripping members (76) to retain said sheet (24); imparting to said frame means (69) a movement on and with respect to said supporting member (37) to set said sheet (24) to a position alongside said second platform (17); and deactivating said gripping members (76) to release said sheet (24) alongside said second platform (17).

15. A method as claimed in claim 14, wherein said movement of said frame means (69) with respect to said supporting member (37) comprises a rotation about a horizontal third axis (73).

16. A method of feeding packaging material to an operating unit (5) of a machine for producing and/or manipulating articles and comprising a feed unit (6) for feeding packaging material (7) at least partly in the form of reels (14) laid flat on a support, the method comprising the steps of feeding each said reel (14), by means of a first transfer device (42), to a relative unwinding pin (34) of the feed unit (6), and unwinding said reel (14) on the relative unwinding pin (34), said unwinding pin (34) being fitted to the periphery of a rotary platform (28) rotating about a substantially horizontal axis (27); the method comprising the further steps of setting said unwinding pin (34) to a substantially radial position with respect to said axis (27); rotating said rotary platform (28), to set said unwinding pin (34) to a vertical receiving position facing upwards, fitting the relative said reel (14) downwards onto said unwinding pin (34) in said receiving position, and rotating said unwinding pin (34), with respect to said rotary platform (28), into an axial position with respect to the rotary platform (28); said reel (14) being unwound with the relative unwinding pin (34) in said axial position, wherein the packaging material (7) is partly in the form of reels (14) supported on at least one first pallet (18), and is partly in the form of blanks (15) arranged in packs (22) on at least one second pallet (21); the method comprising the steps of feeding said packaging material (7), together with the relative said pallets (18, 21), to the same storage area (13) adjacent to the operating unit (5), transferring each said reel (14), by means of the first transfer device (42), directly from said first pallet (18) to a relative unwinding pin (34), unwinding said reel (14) on the relative unwinding pin (34), and transferring each said pack (22) of blanks (15), by means of a second transfer device (54), to input conveying means (56) of said operating unit (5), wherein said first and said second pallet (18, 21) are fed to said storage area (13) respectively onto a first and a second platform (16, 17) located side by side in the storage area (13), wherein said first transfer device (42) is carried by a trolley (79) and said second transfer device (42, 54) and said pickup device (65) are carried by a same supporting member (37) located over said second platform (17); said first transfer device (42) being movable with said trolley (79) alongside said first platform (16); said second transfer device (54) being located underneath said supporting member (37); said pickup device (65) being located on said supporting member (37) above said second transfer device (54); and the method comprising the further step of setting said second transfer device (54) to a position alongside said second platform (17) before said pickup device (65) is activated.

17. A method of feeding packaging material to an operating unit (5) of a machine for producing and/or manipulating articles and comprising a feed unit (6) for feeding packaging material (7) at least partly in the form of reels (14) laid flat on a support, the method comprising the steps of feeding each said reel (14), by means of a first transfer device (42), to a relative unwinding pin (34) of the feed unit (6), and unwinding said reel (14) on the relative unwinding pin (34); said unwinding pin (34) being fitted to the periphery of a rotary platform (28) rotating about a substantially horizontal axis (27); the method comprising the further steps of setting said unwinding pin (34) to a substantially radial position with respect to said; (27), rotating said rotary platform (28), to set said unwinding pin (34) to a vertical receiving position facing upwards, fitting the relative said reel (14) downwards onto said unwinding pin (34) in said receiving position, and rotating said unwinding pin (34), with respect to said rotary platform (28), into an axial position with respect to the rotary platform (28); said reel (14) being unwound with the relative unwinding pin (34) in said axial position, wherein the packaging material (7) is partly in the form of reels (14) supported on at least one first pallet (18), and is partly in the form of blanks (15) arranged in packs (22) on at least one second pallet (21); the method comprising the steps of feeding said packaging material (7), together with the relative said pallets (18, 21), to the same storage area (13) adjacent to the operating unit (5), transferring each said reel (14), by means of the first transfer device (42), directly from said first pallet (18) to a relative unwinding pin (34), unwinding said reel (14) on the relative unwinding pin (34), and transferring each said pack (22) of blanks (15), by means of a second transfer device (54), to input conveying means (56) of said operating unit (5).

* * * * *